US011306708B2

(12) United States Patent
Chong et al.

(10) Patent No.: US 11,306,708 B2
(45) Date of Patent: Apr. 19, 2022

(54) HERMETIC COMPRESSOR HAVING DISCHARGE MUFFLER

(71) Applicant: PANASONIC APPLIANCES REFRIGERATION DEVICES SINGAPORE, Singapore (SG)

(72) Inventors: San Haw Chong, Singapore (SG); Kevin Kai Wei Teo, Singapore (SG)

(73) Assignee: Panasonic Appliances Refrigeration Devices Singapore, Singapore (SG)

( * ) Notice: Subject to any disclaimer, the term of this patent is extended or adjusted under 35 U.S.C. 154(b) by 0 days.

(21) Appl. No.: 17/041,273

(22) PCT Filed: Mar. 27, 2019

(86) PCT No.: PCT/SG2019/050170
§ 371 (c)(1),
(2) Date: Sep. 24, 2020

(87) PCT Pub. No.: WO2019/190399
PCT Pub. Date: Oct. 3, 2019

(65) Prior Publication Data

US 2021/0108627 A1 Apr. 15, 2021

(30) Foreign Application Priority Data

Mar. 28, 2018 (SG) ..... 10201802579W

(51) Int. Cl.
*F04B 39/00* (2006.01)
*F04B 39/12* (2006.01)

(52) U.S. Cl.
CPC ..... *F04B 39/0061* (2013.01); *F04B 39/0072* (2013.01); *F04B 39/122* (2013.01); *F04B 39/125* (2013.01); *F04B 39/127* (2013.01)

(58) Field of Classification Search
CPC ..... F04B 39/0061; F04B 39/0072; F04B 39/122; F04B 39/125; F04B 39/127
(Continued)

(56) References Cited

U.S. PATENT DOCUMENTS 3,044,688 A * 7/1962 Frank ..... F25B 31/02 417/312
3,419,207 A * 12/1968 Hintze ..... F04B 35/04 417/312
(Continued)

FOREIGN PATENT DOCUMENTS

GB 2094900 B 5/1984
JP 2008038693 A 2/2008
(Continued)

OTHER PUBLICATIONS

International Search Report and Written Opinion of International Search Authority for International Application No. PCT/SG2019/050170.
(Continued)

*Primary Examiner* — Christopher S Bobish
(74) *Attorney, Agent, or Firm* — JCIP; Joseph G. Chu; Jeremy I. Maynard

(57) ABSTRACT

A hermetic compressor is disclosed. The hermetic compressor comprises compressing unit and an electromotive unit. The compressing unit comprises: a cylinder block having a compression chamber; cylinder head having a discharge chamber which is controllably couplable to the compression chamber; a discharge muffler body portion and a discharge muffler cover which form a discharge muffler chamber coupled to the discharge chamber; a piston configured to compress a refrigerant in the compression chamber; and a main frame having a least one mounting leg. The electromotive unit comprises: a stator; a rotor; and a crankshaft coupled to the rotor. The electromotive unit is configured
(Continued)

such that rotary motion of the rotor relative to the stator causes rotation of the crankshaft which drives the piston to compress the refrigerant in the compression chamber. The compressing unit is coupled to the stator of the electromotive unit and supported by the at least one mounting leg of the main frame and the discharge muffler cover.

7 Claims, 6 Drawing Sheets

(58) Field of Classification Search
USPC ..... 417/902
See application file for complete search history.

(56) References Cited

U.S. PATENT DOCUMENTS 4,115,035 A 9/1978 Tankred et al.
4,406,593 A 9/1983 Kessler
4,431,383 A * 2/1984 Boehmler ..... F04B 39/127 417/312
4,547,131 A * 10/1985 Riffe ..... F04B 35/04 29/464
4,559,686 A 12/1985 Kessler
5,173,034 A * 12/1992 Riffe ..... F04B 39/0061 417/312
5,288,212 A 2/1994 Lee
6,626,648 B1 * 9/2003 Kim ..... F04B 39/0072 417/312
2004/0009077 A1 * 1/2004 Seo ..... F04B 39/0061 417/312
2004/0213681 A1 * 10/2004 Kim ..... F04B 39/0072 417/312
2007/0266724 A1 * 11/2007 Yoon ..... F04B 39/1073 62/296
2009/0022605 A1 1/2009 Kim
2014/0227114 A1 * 8/2014 Bortoli ..... F04B 39/0072 417/312

FOREIGN PATENT DOCUMENTS

KR 20040001816 A 1/2004
WO 2007108603 A1 9/2007

OTHER PUBLICATIONS

International Preliminary Report on Patentability for International Application No. PCT/SG2019/050170.
Extended European search report for European Application No. 19777317.

* cited by examiner

HERMETIC COMPRESSOR HAVING DISCHARGE MUFFLER

TECHNICAL FIELD

The present disclosure relates to hermetic compressors and in particular, to the support of a compressing unit in a hermetic compressor having a discharge muffler.

BACKGROUND

A typical reciprocating compressor comprises a compressing unit and an electromotive unit disposed within a case. The compressing unit comprises a cylinder block which is supported by a main frame. The main frame has a plurality of mounting legs.

The compressing unit further comprises a cylinder head which has a suction chamber and a discharge chamber. In use, a refrigerant is compressed by a piston driven by the electromotive unit. The compressed refrigerant flows from the refrigerant discharge chamber at the cylinder head to a discharge muffling system which comprises one or chambers formed at one side of the cylinder block.

The discharge muffling system is designed to attenuate the pulsation of the gases pumped by the compressor to the refrigeration system as well as to reduce the noise irradiated by the compressor to the external environment. Several constructions are used for said muffling chamber system and the configuration such as the volume of chamber or sequence of tubes can be varied. However, the design of the configuration faces restrictions when combined with recent developments in to miniaturize compressors.

SUMMARY OF THE INVENTION

According to an embodiment of the present invention, hermetic compressor comprises compressing unit and an electromotive unit. The compressing unit comprises: a cylinder block having a compression chamber; cylinder head having a discharge chamber which is controllably couplable to the compression chamber; discharge muffler body portion and a discharge muffler cover which form a discharge muffler chamber coupled to the discharge chamber; a piston configured to compress a refrigerant in the compression chamber; and a main frame having a least one mounting leg. The electromotive unit comprises: a stator; a rotor; and a crankshaft coupled to the rotor. The electromotive unit is configured such that rotary motion of the rotor relative to the stator causes rotation of the crankshaft which drives the piston to compress the refrigerant in the compression chamber. The compressing unit is coupled to the stator of the electromotive unit and supported by the at least one mounting leg of the main frame and the discharge muffler cover.

Because the compressing unit is supported by the discharge muffler cover, the number of mounting legs required to support the compressing unit may be reduced. This allows a hermetic compressor to be realized which is more compact and requires less materials to manufacture. Additionally, this configuration allows the size of the discharge muffler chamber to be maximized relative to the other components of the hermetic compressor.

In some embodiments, the cylinder block, the main frame and the discharge muffler body portion are integrally formed.

In some embodiments, a discharge port is formed in the cylinder block which connects the discharge chamber to the discharge muffler.

The hermetic compressor may further comprise a connecting bolt which attaches the discharge muffler body portion to the stator and passes through the discharge muffler cover thereby holding the discharge muffler cover in place. Such a configuration of connecting bolts removes the requirement of a separate bolt or other connector to hold the discharge muffler cover in place. The connecting bolt may have a head which forms a snubber configured to receive a suspension spring.

A refrigerant discharge pipe may be coupled to the first chamber cover. The discharge muffler chamber may be laterally displaced form the compression chamber.

The hermetic compressor may further comprise a second discharge muffler.

BRIEF DESCRIPTION OF THE DRAWINGS

In the following, embodiments of the present invention will be described as non-limiting examples with reference to the accompanying drawings in which.

DETAILED DESCRIPTION

Figure 1:
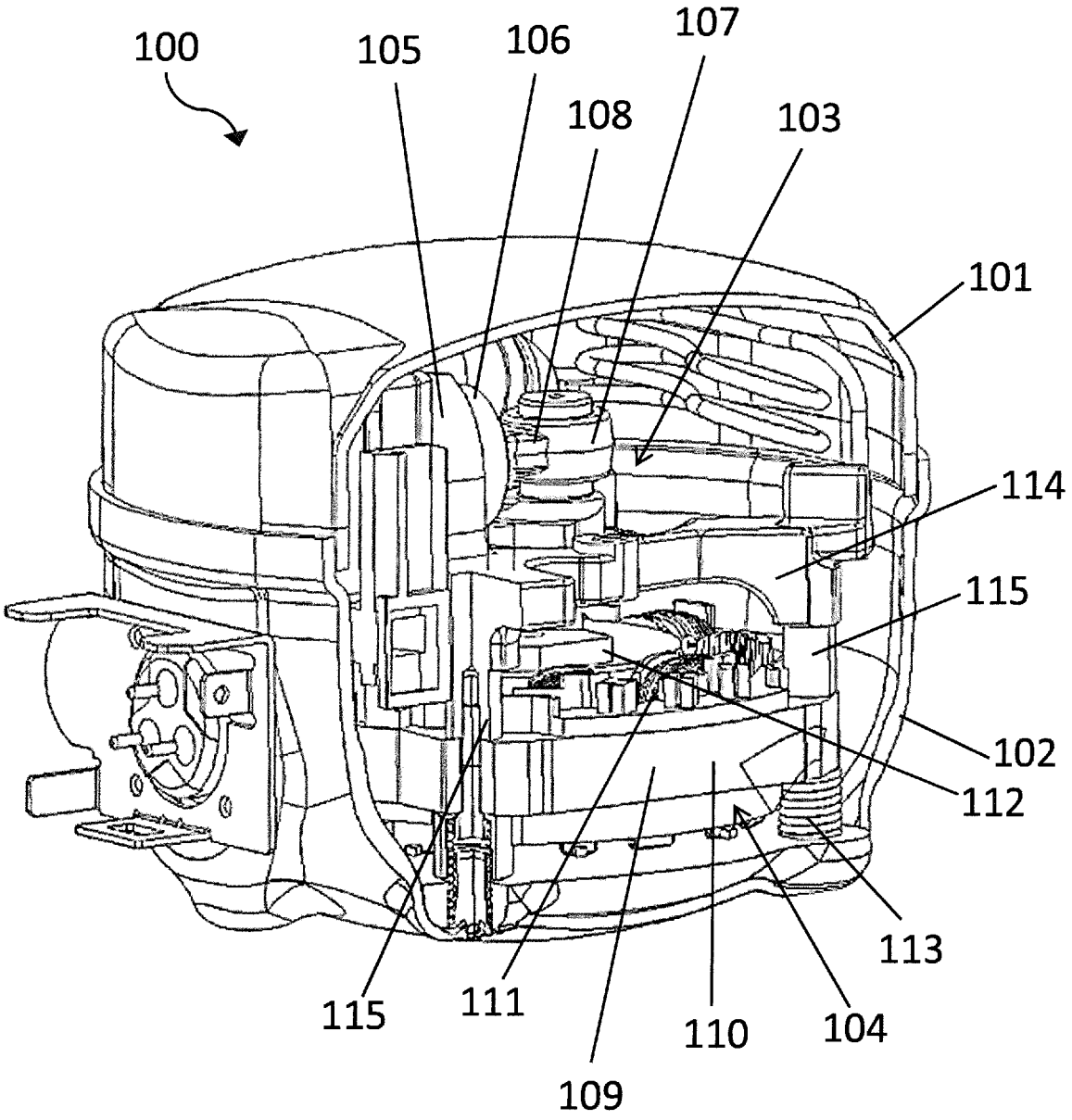
FIG. 1 shows a cut-away view of a hermetic compressor.

FIG. 1 shows a cut-away view of a hermetic compressor. The hermetic compressor 100 comprises an airtight container which is formed from an upper shell 101 and a lower shell 102. The hermetic compressor 100 comprises a compressing unit 103 which is driven by an electromotive unit 104. The compressing unit 103 comprises a cylinder block 105, a piston 106, a crankshaft 107 and a connecting rod 108. The electromotive unit 104 comprises a stator 109 which comprises a stator core 110 and a plurality of stator coil windings 111. A rotor 112 is located within the stator 109. As shown in FIG. 1, the compressing unit 103 is arranged above the electromotive unit 104. The lower part of the compressing unit forms a main frame 114 which has a plurality of mounting legs 115. The electromotive unit 104 supports the compressing unit 103 via the mounting legs 115. As shown in FIG. 1, the stator core 110 is coupled to the mounting legs 115 of the main frame 114. The electromotive element 104 is supported above the base of the bottom airtight container portion 102 by a plurality of suspension springs 113.

In use, an electric current is supplied to the coil windings 111 of the stator 109. This results in a varying magnetic field produced by the stator coil windings 111 and the stator core 109. This magnetic field causes the rotor 112 to rotate within the stator 109. The rotation of the rotor 112 cause the crankshaft 107 to rotate. The rotation of the crankshaft 107 causes the piston 106 to reciprocate within a cylinder in the cylinder block 105. This reciprocation compresses a refrigerant as part of a refrigeration cycle.

The discharge muffling system is designed to attenuate the pulsation of the gases pumped by the compressor to the refrigeration system or, generally, to the high pressure side of the circuit with which the compressor is associated. The discharge muffling system also acts to reduce the noise transmitted by the compressor to the external environment. The pulsation of the gases generates an excitation in the ducts and components to which the compressor discharge is coupled. Such excitation, in turn, generates noise, which is always undesirable. Several constructions are used for said muffling chamber system. However, generally, the principle involves making the gas flow to pass through a sequence of tubes, volumes and localized restrictions with dimensions selected according to the application, type and size of the compressor and taking into consideration noise bands intended to be attenuated.

In embodiments of the present invention, the volume of the discharge muffler chamber can be enlarged even in a miniaturized compressor. This additional volume results from the placement of the discharge muffler chamber below the main frame as a leg. Hence, the enlarged volume can attenuate noise bands that require a large muffler volume.

Figure 2A:
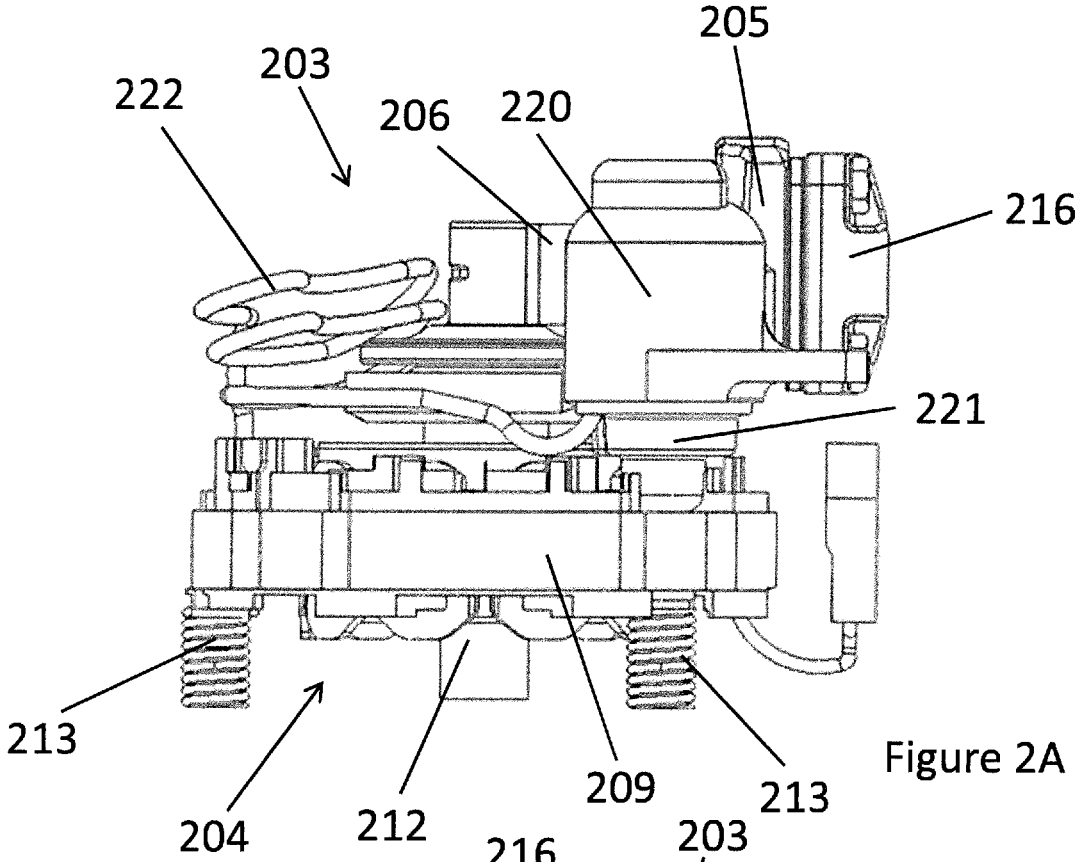
FIG. 2A is a front view of a compressing unit and an electromotive unit according to an embodiment of the present invention.
Figure 2B:
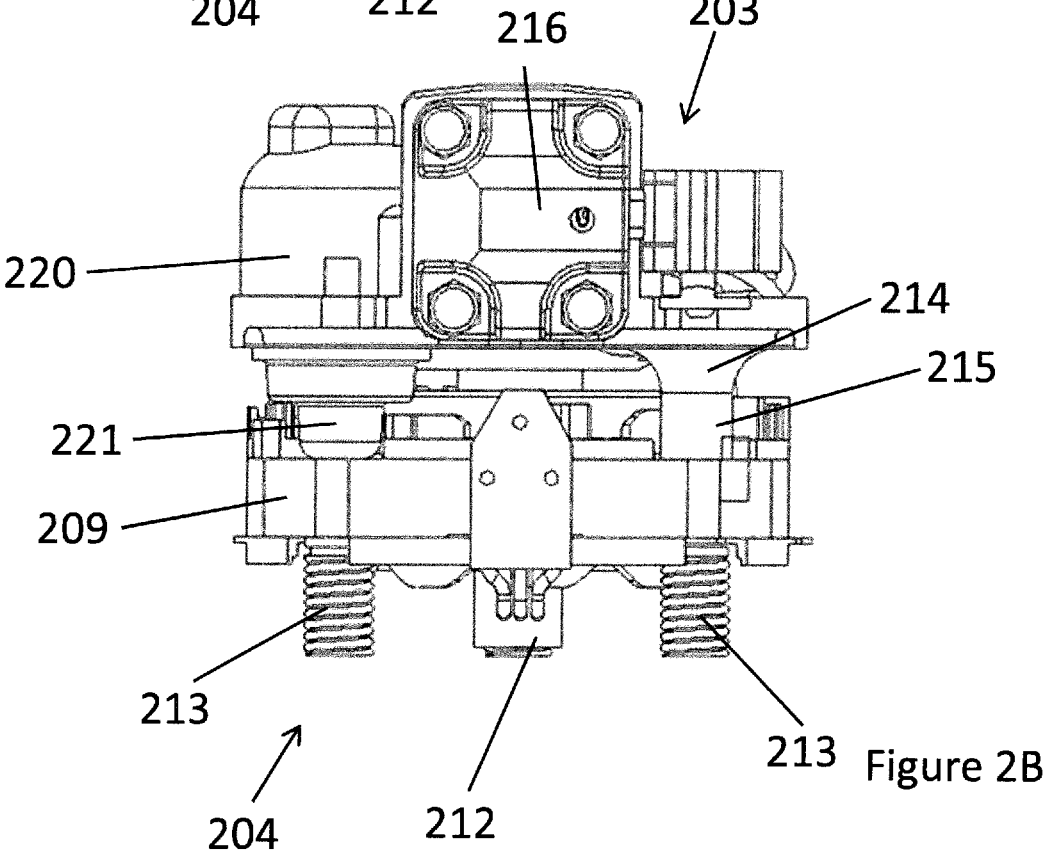
FIG. 2B is a side view of a compressing unit and an electromotive unit according to an embodiment of the present invention.
Figure 2C:
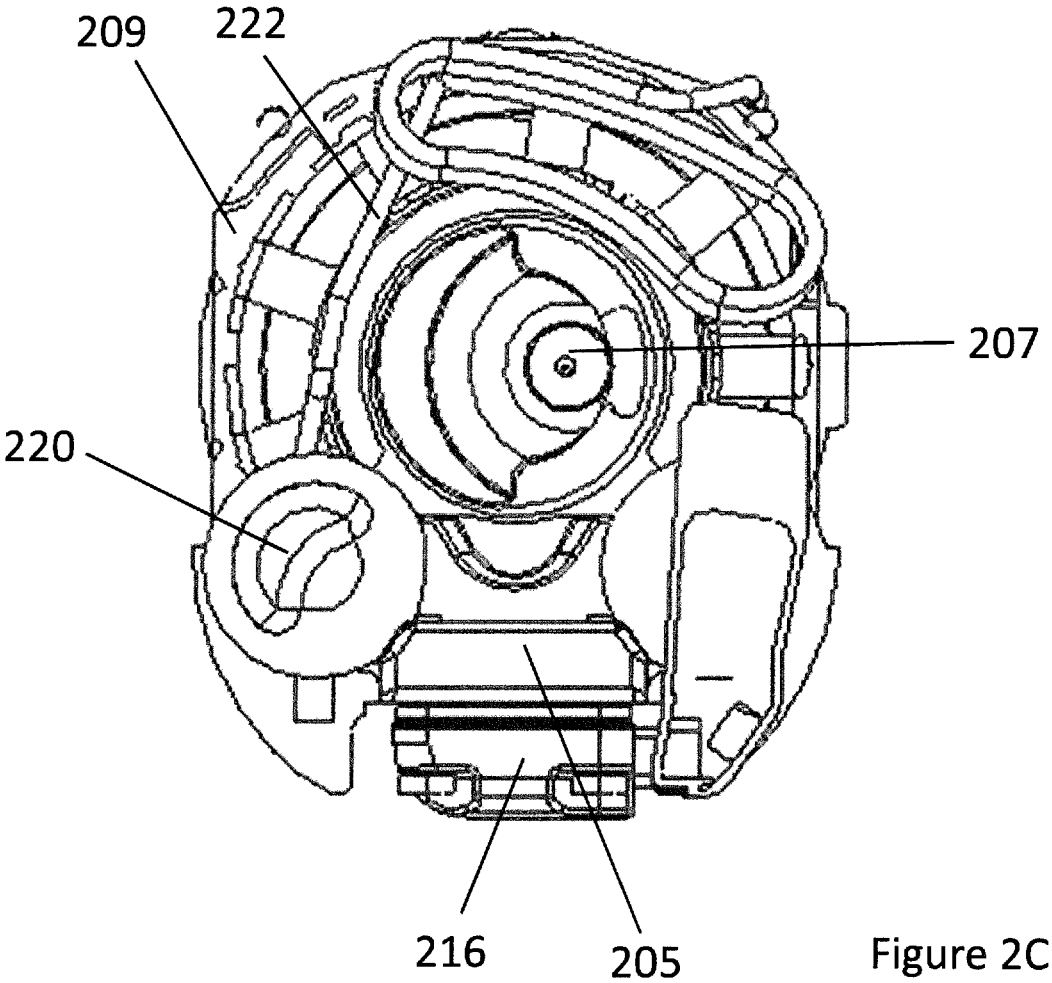
FIG. 2C is a top view of a compressing unit and an electromotive unit according to an embodiment of the present invention.

FIGS. 2A to 2C show views of a compressing unit 203 and an electromotive unit 204 according to an embodiment of the present invention. FIG. 2A is a front view, FIG. 2B is a side view and FIG. 2C is a top view.

The electromotive unit 204 comprises a stator 209 and a rotor 212 which is arranged inside the stator 209. The stator 209 is supported by suspension springs 213 which are arranged at the periphery of the stator 209. The compressing unit 203 comprises a cylinder block 205. The cylinder block 205 encloses a compression chamber 206. One end of the compression chamber 206 is covered by a cylinder head 216. The cylinder head 216 has a refrigerant suction chamber and a refrigerant discharge chamber. A Value assembly controls the flow rate of refrigerant between the refrigerant suction chamber (not shown) and the compression chamber 206 of the cylinder block 205, and also between the compression chamber and the refrigerant discharge chamber. The refrigerant discharge chamber of the cylinder head 216 is coupled to a discharge muffler. The discharge muffler protrudes from an upper and lower surface of the cylinder block 205, and a discharge muffler cover 221 provides a cover for sealing the discharge muffler at one end. The discharge muffler cover 221 is connected to a refrigerant discharge pipe 222 through which refrigerant is fed to a condenser (not shown). On the front side of the cylinder block (refer to FIG. 5*c*), a refrigerant port is formed, intercommunicating the discharge muffler with the refrigerant discharge chamber. The discharge muffler is formed from a discharge muffler body portion 220 and a discharge muffler cover 221. A refrigerant discharge pipe 222 is connected to the discharge muffler cover 221.

The compressing unit 203 is supported by a main frame 214 which forms a lower surface of the compressing unit 203. The frame 214 comprises a mounting leg 215 which supports the compressing unit 203 and is coupled to the stator 209.

As shown in FIG. 2B, the discharge muffler cover 221 is also coupled to the stator 209. Thus, the mounting leg 215 of the main frame 214 and the discharge muffler cover 221 supports the compressing unit 203.

The discharge muffler is formed at one side of the compression chamber and as can be seen in FIG. 2A and FIG. 2B, the discharge muffler extends through substantially the full height of the compressing unit 203.

As shown in FIG. 2C, the cylinder block 205 is arranged in front of the crankshaft 207 and the cylinder head 216 is arranged in front of the cylinder block 205. The discharge muffler body portion 220 is arranged at one side of the cylinder block 205. The refrigerant discharge pipe 222 extends from the discharge muffler to the back of the compressing unit 203 and includes several loops on the opposite side of the crankshaft from the cylinder block 205 and the cylinder head 216. The stator 209 is approximately circular in cross section and the overall profile of the compressor approximates this circular cross section.

Figure 3:
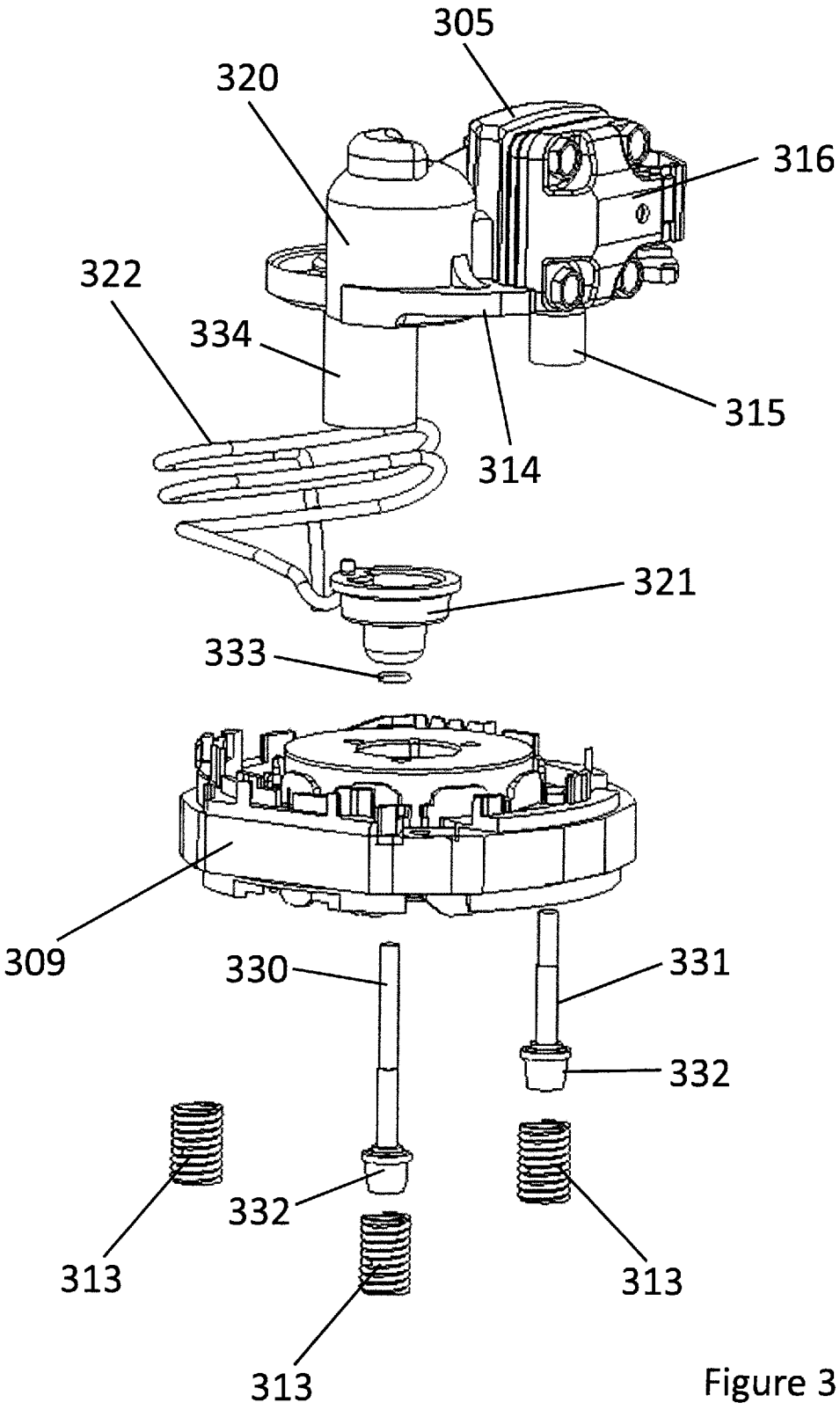
FIG. 3 is an exploded view of a compressing unit and an electromotive unit according to an embodiment of the present invention.

FIG. 3 is an exploded view of a compressing unit and an electromotive unit according to an embodiment of the present invention. As is described in more detail below with reference to FIGS. 5A to 5C, the cylinder block 305, the discharge muffler body portion 320, and the main frame 314 are integrally formed as a single part. A mounting leg 315 extends downwards from the main frame 314. A bearing 334 extends downwards from the center of the compressing unit. When the compressor is fully assembled, the crankshaft runs through the bearing 334. The cylinder head 316 is attached to the cylinder block 305. The discharge muffler body portion 320 is arranged at one side of the cylinder block 305 and the mounting leg 315 extends downwards from the opposing side of the cylinder block 305.

The discharge muffler cover 321 is arranged below the discharge muffler body portion 320. The refrigerant discharge pipe 322 extends from the discharge muffler cover 321. The stator 309 is arranged below the compressing unit.

A first connecting bolt 330 runs through a hole in a peripheral region of the stator 309 and passes through a washer 333 before passing through a hole in the bottom of the discharge muffler cover 321. The first connection bolt 330 fastens to a point in the interior of the discharge muffler body portion 320.

A second connecting bolt 331 through a hole in a peripheral region of the stator 309 and fastens to the mounting leg 315. Thus, the first connecting bolt 331 and the second connecting bolt 331 attach the compressing unit to the electromotive unit. When the compressing unit is attached to the electromotive unit, the compressing unit is supported by the mounting leg 315 and the discharge muffler cover 321. The mounting leg 315 and the discharge muffler cover 321 rests against the stator 309 to support the compressing unit.

The bottom ends of the first connecting bolt 330 and the second connecting bolt 331 are provided with snubbers 332 which receive suspension springs 313. A third suspension spring is received by a snubber on the lower side of the stator 309.

Figure 4:
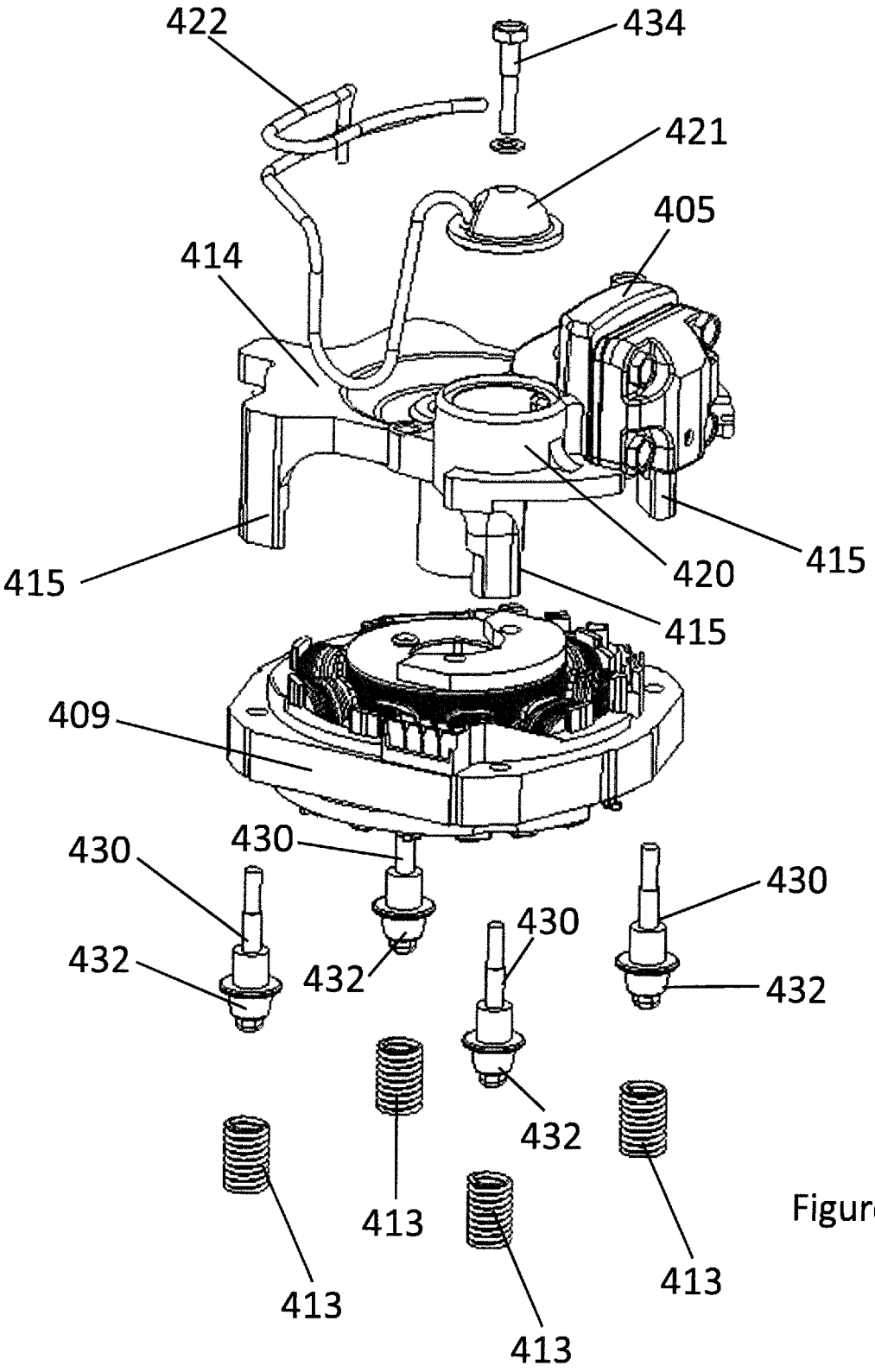
FIG. 4 is an exploded view of a compressing unit and an electromotive unit of a conventional compressor.

FIG. 4 is an exploded view of a compressing unit and an electromotive unit of a conventional compressor. In the conventional compressor, the first discharge muffler 421 fits on the top of the discharge muffler body portion 420. The discharge muffler body portion 420 is located at one side of the cylinder block 405. The refrigerant discharge pipe 422 runs from the discharge muffler cover 421. A fixing bolt 434 fastens the discharge muffler cover 421 to the discharge muffler body portion 420. The discharge muffler body portion 420 and the cylinder block 405 are integrally formed with the main frame 414. Four mounting legs 415 extend downward from the main frame 414.

When the compressor is assembled, the mounting legs 415 support the compressing unit above the stator 409 of the electromotive unit. Four connecting bolts 430 run through holes in the stator 409 and attach to respective mounting legs 415. Thus the electromotive unit is attached to the compressing unit. Each of the connecting bolts 430 are provided with snubbers 432 which are formed from the heads of the connecting bolts 430. The snubbers 432 receive suspension springs 413 which support the compressor.

From a comparison of FIGS. 3 and 4 it can be seen that the arrangement of the discharge muffler cover 321 on the bottom of the compressing unit has several advantages. Firstly, the discharge muffler can occupy a larger height relative to the other components. Thus the height of the discharge muffler can be maximized relative to the size of the compressor. Secondly, the number of mounting legs required can be reduced since the compressing unit is also supported by the discharge muffler cover. Thirdly, lesser parts are required since a separate fixing bolt to fasten the discharge muffler chamber in place is not required as the discharge muffler cover is held in place by one of the connecting bolts.

Figure 5A:
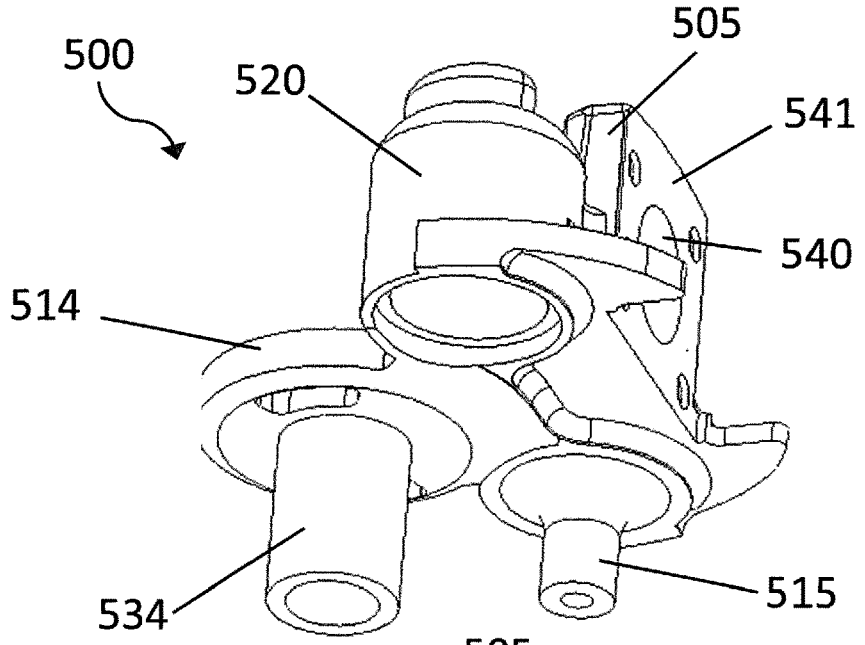
FIGS. 5A to 5C are views of an integrated cylinder block of a hermetic compressor according to an embodiment of the present invention.
Figure 5B:
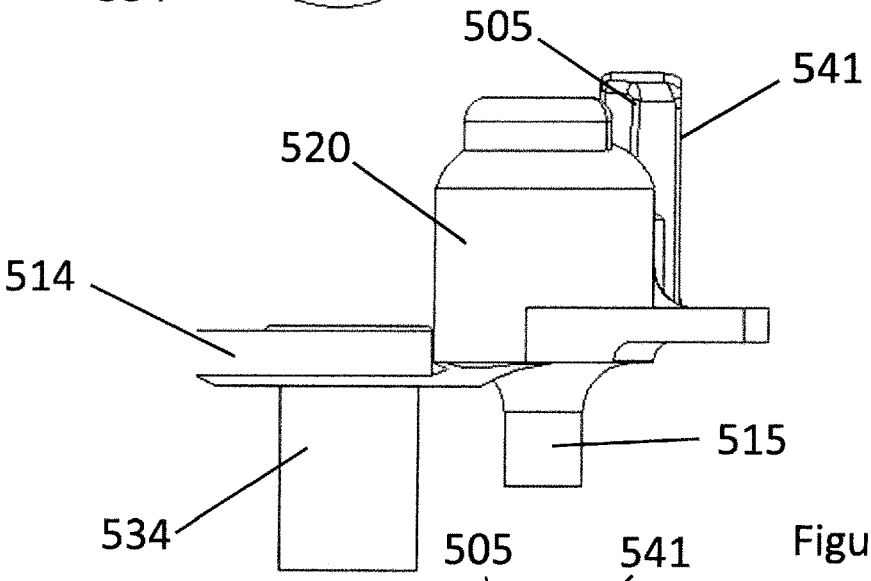
Figure 5C:
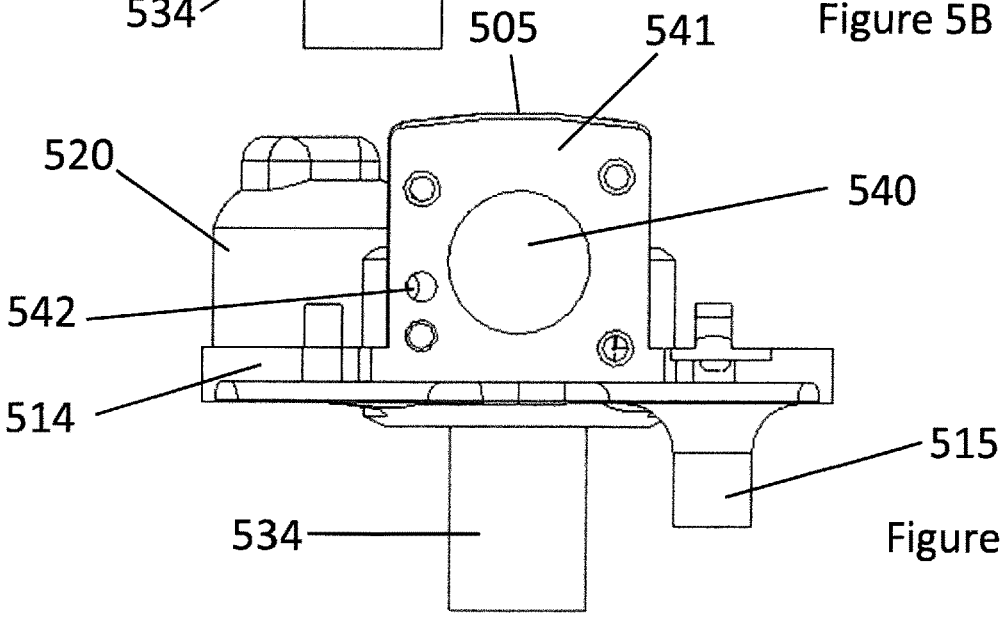

FIGS. 5A to 5C are views of an integrated cylinder block of a hermetic compressor according to an embodiment of the present invention. FIG. 5A is a perspective view, FIG. 5B is a side view and FIG. 5C is a front view of the integrated cylinder block 500. The integrated cylinder block 500 is formed as a single part.

The integrated cylinder block 500 comprises a main frame 514. The discharge muffler body portion 520 extends upwards from the main frame 514 and is approximately cylindrical in shape. The discharge muffler body portion 520 has an opening facing downwards which is covered by the discharge muffler cover. The cylinder block 540 extends upwards from the main frame 514 and has a circular opening 540 which leads to the compression chamber. The circular opening 540 is formed in a flat side surface 541 of the cylinder block 505 which faces the front of the compressor. When the compressor is assembled, the flat side surface 541 is covered by the cylinder head. A bearing 534 extends downwards from the main frame 514. The bearing 534 receives the crankshaft when the compressor is assembled. A mounting leg 515 extends downwards from the main frame 515.

As can be seen from FIG. 5C, when viewed from the front, the discharge muffler body portion 520 is arranged on one side of the cylinder block 505 and the mounting leg 515 extends downwards from the main frame 514 at the opposing side of the cylinder block 505. A refrigerant port 542 is located on the flat side surface 541 of the cylinder block 540. The refrigerant port 542 couples to the discharge muffler body portion 520 and when the compressor is assembled, the refrigerant port 542 couples the refrigerant discharge chamber of the cylinder head to the discharge muffler.

Further embodiments are envisaged in which a second discharge muffler is coupled to the output of the first discharge muffler. The dimensions of the second discharge muffler may be selected to match those or the first discharge muffler or may be selected to be different from those of the first, for example to damp vibrations of a different frequency.

Whilst the foregoing description has described exemplary embodiments, it will be understood by those skilled in the art that many variations of the embodiments can be made within the scope and spirit of the present invention.

The invention claimed is:

1. A hermetic compressor comprising a compressing unit and an electromotive unit, the compressing unit comprising:

a cylinder block having a compression chamber;

a cylinder head having a discharge chamber which is controllably couplable to the compression chamber;

discharge muffler body portion and a discharge muffler cover which form a discharge muffler chamber coupled to the discharge chamber;

a piston configured to compress a refrigerant in the compression chamber; and a main frame having at least one mounting leg, the electromotive unit comprising:

a stator;

a rotor; and a crankshaft coupled to the rotor, wherein the electromotive unit is configured such that rotary motion of the rotor relative to the stator causes rotation of the crankshaft which drives the piston to compress the refrigerant in the compression chamber, and wherein the compressing unit is coupled to the stator of the electromotive unit and supported by the at least one mounting leg of the main frame and the discharge muffler cover, the hermetic compressor further comprising a connecting bolt which attaches the discharge muffler body portion to the stator and passes through the discharge muffler cover thereby holding the discharge muffler cover in place.

2. The hermetic compressor according to claim 1, wherein the cylinder block, the main frame and the discharge muffler body portion are integrally formed.

3. The hermetic compressor according to claim 1, further comprising a discharge port formed in the cylinder block, the discharge port connecting the discharge chamber to the discharge muffler.

4. The hermetic compressor according to claim 1, wherein the connecting bolt has a head which forms a snubber configured to receive a suspension spring.

5. The hermetic compressor according to claim 1, further comprising a refrigerant discharge pipe coupled to the discharge muffler cover.

6. The hermetic compressor according to claim 1, wherein the discharge muffler is laterally displaced from the compression chamber.

7. The hermetic compressor according to claim 1, further comprising a second discharge muffler.

* * * * *